United States Patent [19]

Metz

[11] Patent Number: 4,568,040

[45] Date of Patent: Feb. 4, 1986

[54] TERMINAL GUIDANCE METHOD AND A GUIDED MISSILE OPERATING ACCORDING TO THIS METHOD

[75] Inventor: Pierre Metz, Paris, France

[73] Assignee: Thomson-Brandt, Paris, France

[21] Appl. No.: 446,728

[22] Filed: Dec. 3, 1982

[30] Foreign Application Priority Data

Dec. 9, 1981 [FR] France ..... 81 23025

[51] Int. Cl.[4] ..... F41G 7/22; F42B 25/24

[52] U.S. Cl. ..... 244/3.22; 102/384; 244/3.16

[58] Field of Search ..... 102/384, 489; 244/3.16, 244/3.21, 3.22

[56] References Cited

U.S. PATENT DOCUMENTS

| | | | |
|---|---|---|---|
| 2,520,433 | 8/1950 | Robinson | 244/14 |
| 3,000,307 | 9/1961 | Trotter, Jr. | 102/384 |
| 3,072,365 | 1/1963 | Linscott et al. | 244/3.21 |
| 3,282,540 | 11/1966 | Lipinski | 244/3.16 |
| 3,374,967 | 3/1968 | Plumley | 244/3.22 |
| 3,843,076 | 10/1974 | King et al. | 244/3.22 |
| 4,039,246 | 8/1977 | Voigt | 244/3.16 |
| 4,076,187 | 2/1978 | Metz | 244/3.23 |
| 4,183,664 | 1/1980 | Rambauske | 244/3.16 |
| 4,193,567 | 3/1980 | McCarthy, Jr. | 244/3.16 |
| 4,347,996 | 9/1982 | Grosso | 244/3.16 |
| 4,383,663 | 5/1983 | Nichols | 244/3.16 |
| 4,394,997 | 7/1983 | Maudal | 244/3.16 |
| 4,408,735 | 10/1983 | Metz | 244/3.22 |

FOREIGN PATENT DOCUMENTS

| | | | |
|---|---|---|---|
| 0025373 | 3/1981 | European Pat. Off. | 244/3.22 |
| 1092312 | 11/1960 | Fed. Rep. of Germany . | |
| Ad.71802 | 2/1960 | France . | |
| 2230958 | 12/1974 | France . | |
| 2231947 | 12/1974 | France . | |
| 2478297 | 9/1981 | France . | |

*Primary Examiner*—Charles T. Jordan

*Attorney, Agent, or Firm*—Roland Plottel

[57] ABSTRACT

A guidance method is provided for the terminal portion of the trajectory of a guided missile having a sensor and comprising two sections coupled together by a central shaft and free to rotate with respect to one another about the longitudinal axis of the missile; one section comprises a drive means for controlling the roll attitude of this section and a gas generator which feeds a nozzle for providing a transverse throat force and the other section has a stabilizing tail unit formed by a set of fins able to be opened out.

16 Claims, 18 Drawing Figures

TERMINAL GUIDANCE METHOD AND A GUIDED MISSILE OPERATING ACCORDING TO THIS METHOD

BACKGROUND OF THE INVENTION

The invention relates to guided missiles and, more precisely, to a method for guiding a missile, applicable during the terminal portion of the flight path; it also relates to a guided missile operating according to this guidance method.

There exists a demand for AIR to GROUND missiles capable of stopping, at relatively large distances, the threat presented by land formations formed more especially by motorized vehicles such as armored vehicles advancing in groups over the terrain. These armored vehicles, by their nature, radiate thermal energy and thus constitute potential targets which may be detected and located by a missile fitted for example with an electro-optical E.O. sensor operating in the IR band of the electromagnetic spectrum. Furthermore, the missile may be provided with a military charge capable of piercing the protecting armor of armored vehicles. It is possible to direct the firing of such a missile towards a group of armored vehicles; however, there remains the problem of supplying, during the terminal portion of the downward trajectory towards the ground, the trajectory corrections for providing impact of a missile on one of the vehicles detected by the EO sensor.

A missile is already known comprising guidance means for correcting, in the terminal phase of the flight path, the possible error between the direction of a target and the direction of impact of the missile on the ground, in free fall. To this end, the base of this missile of the prior art is equipped with a set of fins which impart to the body of the missile a self rotating movement at a substantially constant angular speed about its longitudinal axis. In the head of the missile is disposed an electro-optical EO sensor and, finally, in the middle part of the body a lateral impeller may supply a predetermined thrust force whose direction is normal to the speed vector of the missile. The EO sensor is formed by a plurality of photodetector cells arranged in a ring in a plane perpendicular to the axis of the missile, so as to provide a hollow conical field of view. Thus, the surface of the ground covered by the field of view of the EO sensor is gradually reduced as a function of the decreasing altitude of the trajectory. When the target comes into the field of view of the sensor, its image falls on one of the photodetector cells which determines, in polar coordinates, the position of the target with respect to the orientation of the impeller. The output signal of the EO sensor is used to supply an order for triggering the lateral impeller at the moment when the orientation of this latter is opposite the direction of the detected target.

This missile of a relatively simple prior art construction does not allow the degree of efficiency sought to be attained and, more especially, a probable hit on the target to be obtained. To attain this aim, the guidance method proposed uses a sensor for tracking the target which measures the rotation of the missile-target line of sight.

SUMMARY OF THE INVENTION

According to one aspect of the invention there is provided a method for guiding a missile during a terminal portion of the missile's trajectory. The missile has a sensor with a beam sensitive to energy radiated by a potential target. The method includes steps for seeking of a target, and steps for piloting the missile. The target seeking steps include: (a) immobilizing the beam of the sensor along the longitudinal axis of the missile; (b) imparting to the missile a rotation about the longitudinal axis of the missile at a given angular roll speed, and a spiral-line-movement about the trajectory of the missile, so that the beam of the sensor describes a surface of revolution (by creating a transverse thrust force normal to the direction of the speed of movement of the missile), and (c) detecting an image of a possible target picked up by the beam of the sensor. The steps for piloting the missile include (a) freeing the beam of the sensor and maintaining the axis of this beam pointed at the image of the detected target to measure the rotation of the missile-target line of sight; (b) elaborating a piloting order proportional to the measured magnitude of the rotation of the line of sight; and (c) applying this piloting order to modify the roll attitude of the missile.

According to a further aspect of the invention there is provided a guided missile with a sensor sensitive to energy radiated by a potential target. The missile has first and second main sections which are mutually coupled together and which rotates with respect to each other about the longitudinal axis of the body of the missile. The first section has a sensor, and includes a drive with a first member integral with the structure of the front (first main) section. A second member is physically coupled to the second main section. A control input is connected through an amplifier to a generator-of-piloting-orders so as to vary the roll attitude of the body of the missile. A gas generator feeds a lateral nozzle to provide a transverse thrust force. The second main section includes at its base a stabilizing tail unit formed of fins which may be folded out. The sensor of the first section is provided with a locking device for fixing a beam along the longitudinal axis of the missile while the missile is seeking a target.

Another object of the invention consists in conferring on the missile a given initial speed of movement along its trajectory and maintaining it substantially constant along the trajectory.

Another object of the invention is to vary the angular speed of self-rotation of the body of the missile along its terminal trajectory. Furthermore, the second member of the drive means is coupled to the rear section of the missile by a central shaft.

According to a further object of the invention the rear section of the missile comprises a compartment for housing a releasable braking parachute for reducing the ballistic speed of the missile over the portion of the trajectory preceding the terminal phase.

BRIEF DESCRIPTION OF THE DRAWINGS

The characteristics and advantages of the invention will be clear from the detailed description which follows, made with reference to the accompanying drawings which illustrate the guidance method and one embodiment of the guided missile; in these drawings:

FIG. 1 shows, in a simplified form, the missile of the prior art mentioned in the preamble of this application as well as the corresponding terminal guidance method. Missile 1 is equipped with a set of fins 2 whose configuration imparts to the body of this projectile an angular speed of self-rotation $\omega_r$ about its longitudinal axis X carrying the speed vector V of movement of the projectile along its trajectory. In free fall, the trajectory of the missile is inclined by an angle $\theta_t$ and this missile strikes the ground at a point 4 offset angularly by an angle $\theta_c$ from a potential target 6.

For modifying the trajectory of the missile, the missile is fitted with a lateral impeller 3 and an electro-optical sensor 5 which supplies a signal for triggering this impeller, this triggering signal resulting from the measurement of the error angle $\theta_c$. The result is that the speed vector V of the projectile is modified by an amount $V_c$ to provide a resulting speed vector $V_r$ offset by the angle $\theta_c$ from the speed vector V to obtain impact of the missile on the target.

Figure 1:
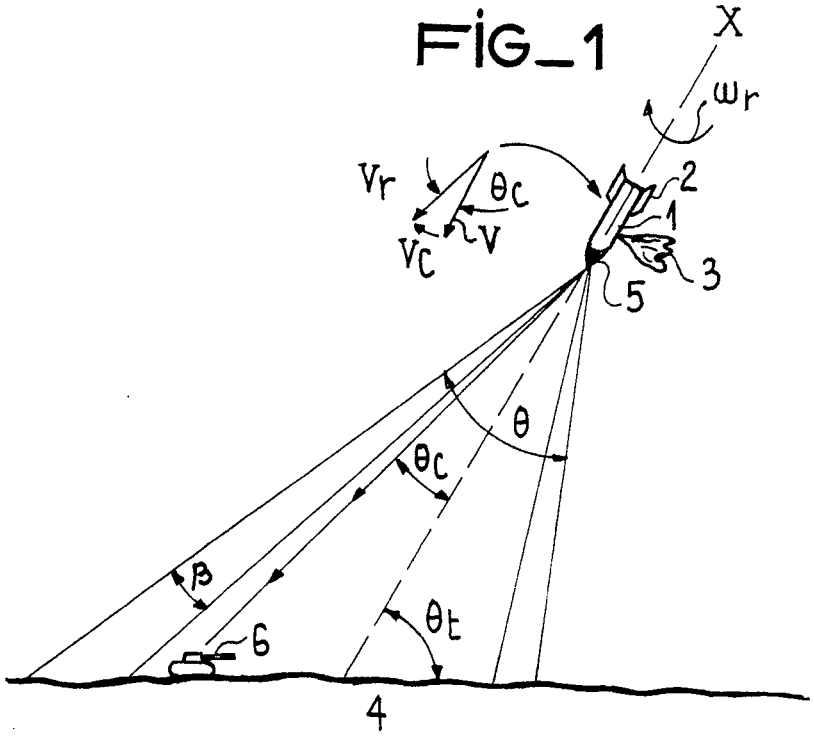
FIG. 1 shows a guided missile of the prior art.
Figure 2:
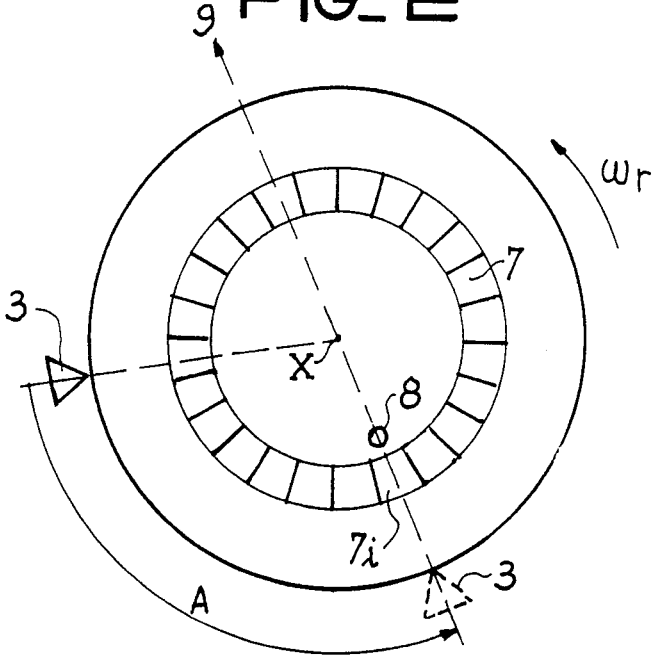
FIG. 2 shows the method of constructing the electro-optical sensor of the missile of the prior art, FIG. 3, in a simplified schematical form, shows a guided missile comprising the means required by the guidance method of the invention.

FIG. 2 shows the embodiment of the electro-optical sensor 5 carried by the missile 1 described in FIG. 1. This EO sensor is formed essentially by a plurality of photo-conducting elements 7 arranged in a ring in a plane orthogonal to the longitudinal axis X of the body of the missile to supply a predetermined hollow conical field of view with angular aperture $\theta$ and angular width $\beta$ (FIG. 1). When the image 8 of target 6 is detected by one of the photoconducting elements 7, such as element $7_i$, the width of the relative angle A between the direction of the impeller 3 and the photoconducting element $7_i$ is measured by the EO sensor and fed to a computing circuit which determines the moment for triggering the impeller 3 corresponding to the impeller passing into the direction of the detected target.

Figure 3:
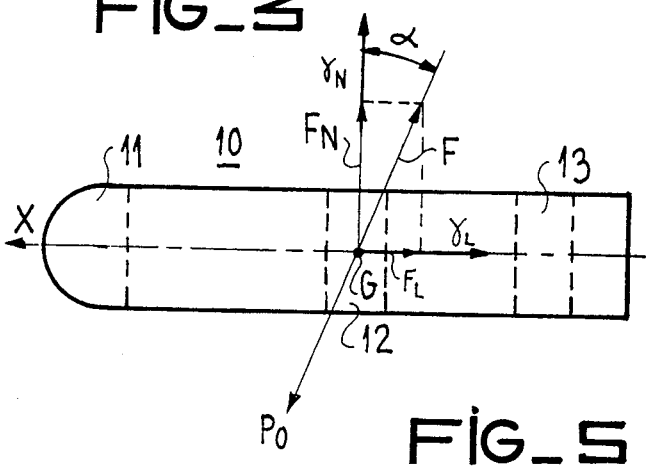

FIG. 3 shows, in a simplified schematical form, a guided missile 3 which comprises means specific to the terminal guidance method of the invention. This missile comprises: a sensor 11, sensitive to the energy radiated by a potential target, situated in the head of the missile, a means 12 for providing a transverse thrust $P_o$ passing through the center of gravity G of the missile and a means 13 for controlling the roll attitude of the body of missile 10 about its longitudinal axis X. The sensor is provided with a locking means for immobilizing its beam along the longitudinal axis X, means for detecting the possible presence of a target intercepted by this beam and angular tracking means for measuring the rotation $\dot{\eta}$ of the target-missile line of sight (L.O.S.). The means 12 for providing a transverse thrust $P_o$ comprises a combustion chamber which supplies a lateral nozzle whose thrust direction is inclined, by an angle $\alpha$, to the longitudinal axis X of the missile; the result is that the transverse $F_N$ and longitudinal $F_L$ components of the force F applied to the missile are given by the following relationships:

$$F_N = F \cos \alpha$$

and $$F_L = F \sin \alpha$$

to which correspond the normal acceleration $\gamma_N$ given by the following relationship $$\gamma_N = \frac{F_N}{M} - g \cdot \cos x$$

and the longitudinal acceleration $\gamma_L$ given by the following relationship:

$$\gamma_L = \frac{F_L}{M} - g \cdot \sin x$$

where M is the mass of the missile and g the magnitude of the Earth's field of gravity.

Figure 4:
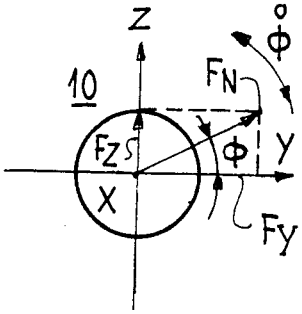
FIG. 4 shows a cross sectional view of the guided missile of FIG. 3.

FIG. 4 shows a section of the missile 10, with axes X, Y and Z; and shows the components $F_Y$ and $F_Z$ of the normal force $F_N$ as a function of the roll angle $\phi$ of the body of the missile about its longitudinal axis X. These components $F_Y$ and $F_Z$ are given by the following relationships:

$$F_Y = F_N \cos \phi$$

$$F_Z = F_N \sin \phi$$

The body of the missile may rotate in both directions, with respect to axis X at an instantaneous angular speed $\dot{\phi}$. The magnitudes $\phi$ and $\dot{\phi}$ may be measured on board the missile and used respectively for controlling the roll attitude and the self-rotational speed of the body of the missile.

Figure 5:
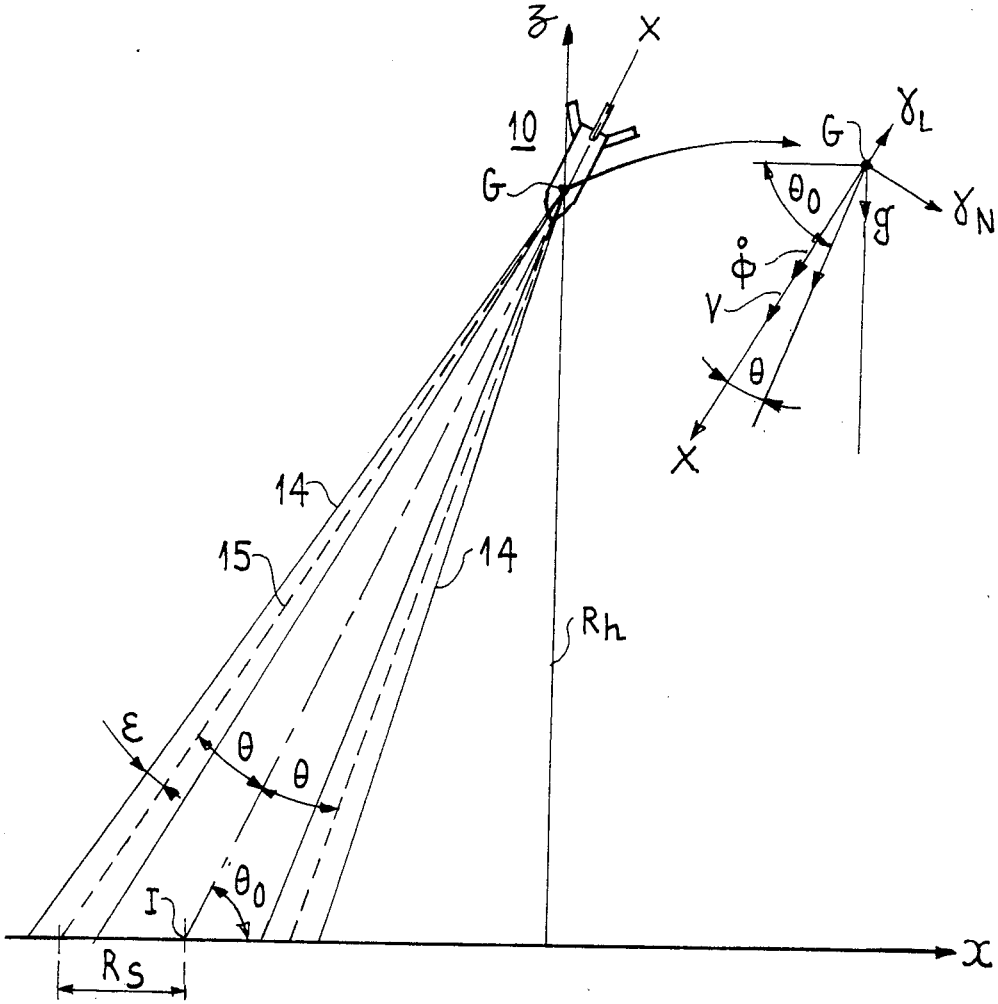
FIG. 5 is a plane diagram of axes x,z associated with the ground and indicating the principal parameters which determine the extent of the ground swept by the beam of the sensor.

FIG. 5 is a plane diagram with axis x, z associated with the ground in which are shown the principal parameters which determine the extent of the ground swept by the beam 14 of the EO sensor carried by the previously described missile 10. The center of gravity G of the missile is driven at a speed of movement V directed along the longitudinal axis X of the body of the missile and it is subjected to a system of three forces. A first force, normal corresponds to an acceleration $\gamma_N$ normal to the speed vector V, a second force, longitudinal corresponds to an acceleration directed along the longitudinal axis X, and a third force, of the Earth's gravity to which corresponds the acceleration vector g directed along the vertical of the locality. The beam 14 of the missile has a relatively narrow half aperture angular field $\epsilon$, a few degrees for example. The straight line G.I. of the downward trajectory of the missile is inclined by an angle $\theta_o$ with respect to the horizontal. Since the body of a missile is subjected to a self-rotational speed $\dot{\phi}$ about its longitudinal axis X and since the beam 14 of the EO sensor is immobilized along this longitudinal axis X, the result is that the beam 14 describes as a function of time a hollow cone, which is a surface of revolution, with axis GI whose external and internal half apertures have for respective values $(\theta+\epsilon)$ and $(\theta-\epsilon)$. Since the altitude $R_h$ of the missile above the ground is reduced proportionally to the time, the axis 15 of beam 14 describes on the ground, as a function of time, a converging spiral with radius $R_s$ centered on point I. The extent of the surface of the ground swept by beam 14 is a circle when the descent angle is equal to 90° and an ellipse of small eccentricity when the value of this angle $\theta$ remains high, 60° to 70° for example.

Figure 6:
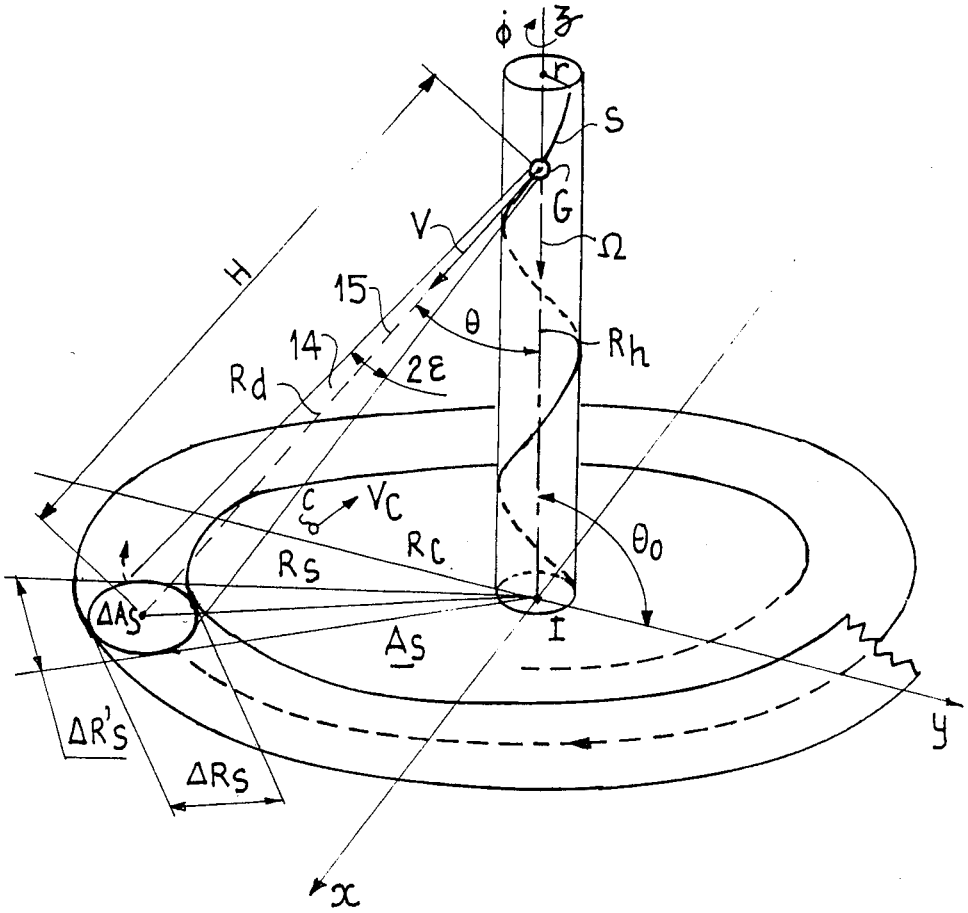
FIG. 6 is a diagram of a trihedron x, y, z associated with the ground and illustrating the method of searching for a potential target.

FIG. 6 is a diagram in a trihedron x, y, z, associated with the ground which illustrates the method for seeking a target by means of the missile described previously, in a particular case corresponding to a descent angle $\theta_o$ equal to 90°. We will consider here the case where the rotational speed $\dot{\phi}$ of the missile about its longitudinal axis X is maintained constant as well as the speed V of the missile while ignoring the force of resistance of the air and considering that the longitudinal acceleration force $\gamma_L$ produced by the nozzle of the missile and the force of gravity g are equal and opposite values. The trajectory S from the center of gravity G of the missile describes a helix carried by a cylinder 16 with vertical axis z passing substantially through point I and the radius of this cylinder has a magnitude r. The extent $A_s$ of the surface of the ground swept by the beam 14 of the EO sensor, describing a surface of revolution, is given by the following formula:

$$\Delta A_s=\pi\cdot(R_h\cdot\tan(\theta+\epsilon))^2$$

The surface of the ground $\Delta A_s$ intercepted by the optical beam is an ellipsis in which the magnitudes of the axes $\Delta R_s$ and $\Delta R'_s$ are given respectively by the relationships:

$$\Delta R_s=\frac{2R_h\sin\epsilon}{\cos^2\theta}$$

$$\text{and } \Delta R'_s=2R_h\sin\epsilon$$

The oblique distance $R_d$, between the missile and the surface $\Delta A_s$ of the ground intercepted by the beam of the EO sensor is given by the following relationship:

$$R_d=\frac{R_h}{\cos\theta}$$

The horizontal distance $R_s$ between the point I and the surface $\Delta A_s$ is given by the following relationship:

$$R_s=R_h\cdot\tan\theta$$

In FIG. 6, there is also shown a target c driven at a speed $V_c$ and distant from point I by a value $R_c$. To ensure a high probability of detecting a target such as c, the angular speed $\Omega$ of the beam 14 of the EO sensor must be determined so as to obtain a certain amount of overlapping of the successive sweep frames.

The passing time of the optical beam over a target C is given by the following relationship:

$$T=\frac{2\epsilon}{\Omega}$$

where $\Omega$ is the angular rotational speed of the beam about the vertical axis z.

Figure 7:
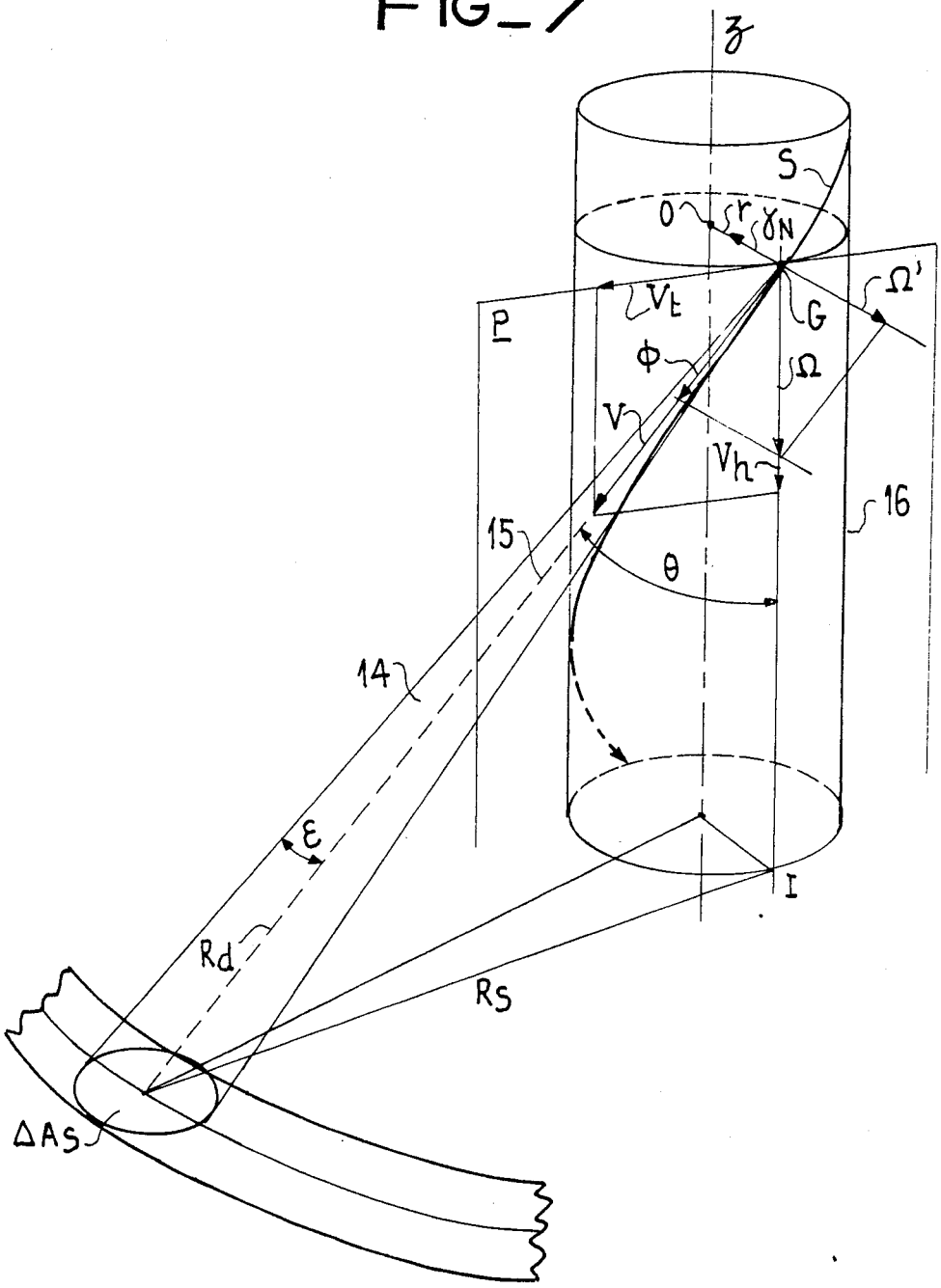
FIG. 7 shows a detailed view of a portion of the trajectory of the missile.

FIG. 7 shows a detailed view of a portion of the trajectory S of missile shown in the preceding figure. The speed vector V of the missile originates at point G representing the center of gravity of the missile, this speed vector V is contained in a plane P tangent to a generatrix of a cylinder 16 carrying point G. The components of the speed vector V are the vertical component $V_h$ and the orthogonal component $V_t$ given by the following relationships:

$$V_h=V\cdot\cos\theta$$

and $$V_t=V\cdot\sin\theta$$

The speed component $V_t$ is tangent to the circle having a center O and a radius r. From the general relationships of the dynamics $$r\Omega^2=\gamma_N=r\left(\frac{\phi}{\cos\theta}\right)$$

with $\Omega=\dot{\phi}/\cos\phi$. By combining the preceding relationships, we obtain the value of the inclination angle $\theta$ of the speed vector V of the missile with respect to the generatrix C.I. of the cylinder $$\tan\theta=\frac{\gamma_N}{V\cdot\phi}$$

Figure 8:
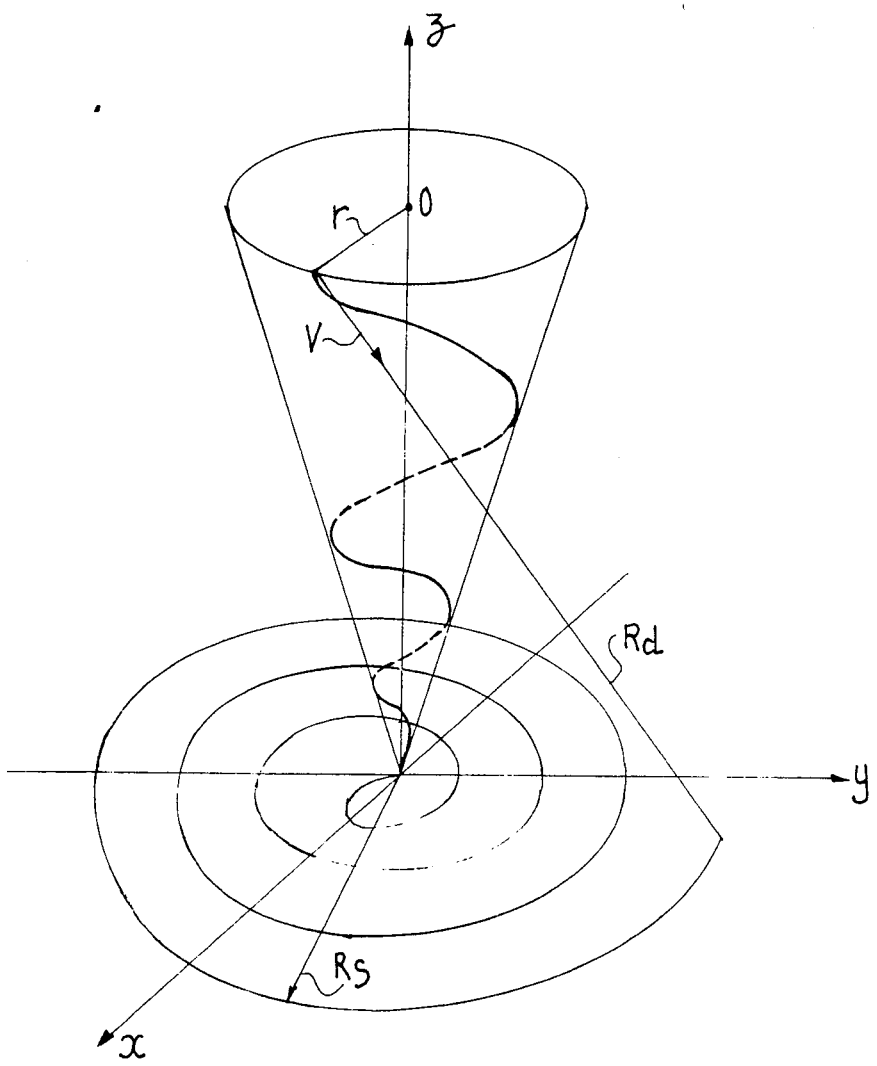
FIG. 8 is a simplified diagram showing a variation of the seeking trajectory.

FIG. 8 is a simplified diagram showing a variation of the method for seeking a target on the ground. According to this variation, the angular roll speed $\dot{\phi}$ of the missile about its longitudinal axis X, is varied as a function of the the altitude $R_h$ of the missile above the ground. The preceding formulae giving the values of the width $\Delta R_s$ of the successive sweep frames and the angle of inclination $\theta$ of the speed vector V of the missile may be rewritten in an approximate form:

$$\Delta R_s=2H\cdot\epsilon \text{ meters}$$

$$\text{and } \theta\cong\frac{\gamma_N}{V\cdot\phi}$$

assuming that the values of angles $\epsilon$ and $\theta$ are still small.

It follows, that if the adjacent sweep frames of the beam of the EO sensor overlap with an overlapping factor of 50%, we have the following relationship:

$$(\dot{\phi})^2 \simeq \frac{2\pi \cdot \gamma_N}{H \cdot \epsilon} \text{ rad.}^2 s^{-1}$$

The result is that the trajectory S of the center of gravity G of the missile is inscribed on the surface of a cone of radius r such that:

$$r \simeq \frac{H \cdot \epsilon}{2\pi}$$

We have just analysed in detail the initial portion of the terminal trajectory of the missile corresponding to the phase of seeking a possible target situated in a zone $A_s$ on the ground centered on the descent axis of the missile. In what follows, the final portion of the trajectory of the missile will be described corresponding to the acquisition of the image of the target by the sensor and, consecutively, to piloting the missile so as to obtain impact on the detected target. Referring again to FIGS. 6 and 7, it can be seen that, when plane P, in its rotational motion with respect to the vertical axis z passes, at a given moment, in the vicinity of point C corresponding to the position of a target and that the following relationship:

$$R_c \simeq R_h \cdot \tan\theta$$

is substantially satisfied, the EO sensor detects the image of the target. From this moment, the EO sensor supplies the following output signals: a first output signal indicating the presence of a target in beam 14 and a second output signal proportional to the rotational speed of the missile-target line of sight. The first output signal is used for freeing the beam of the optical sensor and allowing angular tracking of the sensor on the image of the target; the second output signal, once the angular tracking has been ensured, is fed to a computing means for controlling the roll attitude of the body of the missile and, consequently, directionally piloting the missile.

Figure 9:
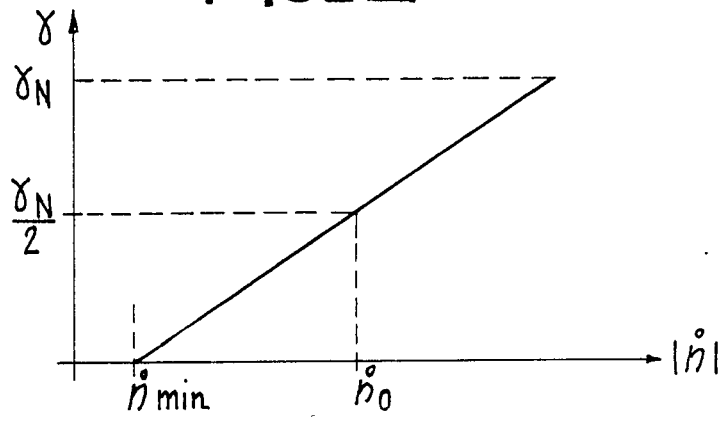
FIG. 9 shows the law of acceleration conferred on the missile as a function of the magnitude of the rotation of the missile-target line of sight.

FIG. 9 is a diagram which shows the rotational speed vector $\dot{\eta}$ of the missile-target line of sight. $F_N$ being the thrust force normal to the speed vector V passing through the longitudinal axis X of the missile and $\Delta\phi$ the orientation angle of this thrust force $F_N$.

The equation of the piloting law of the missile is in the form $$\gamma_\eta = \gamma_N \cos\Delta\phi = 2\dot{\eta} \cdot V + A(\dot{\eta} - \dot{\eta}_o) \cdot V$$

which corresponds to a law of proportional navigation. The gain A comprises a bias $\dot{\eta}$. If, by way of example, we make the acceleration $(\gamma N)/2$ correspond to this bias, which has the advantage of giving an equal margin of maneuverability on each side of the magnitude $\eta_o$ given by the following relationship:

$$\dot{\eta}_o = \frac{V}{4} \cdot \gamma_N$$

Consequently, the input piloting signal is proportional to the magnitude $\dot{\eta}$ and the response is the magnitude $\Delta\phi$ of the orientation of the thrust force $F_N$ with respect to the direction of the rotational vector $\dot{\eta}$ such that $$\Delta\phi = \text{Arc cos}\,(K\dot{\eta} + K_o)$$

since the terms $\dot{\eta}_o$ and V of the equation of the guidance law are constants.

Figure 10:
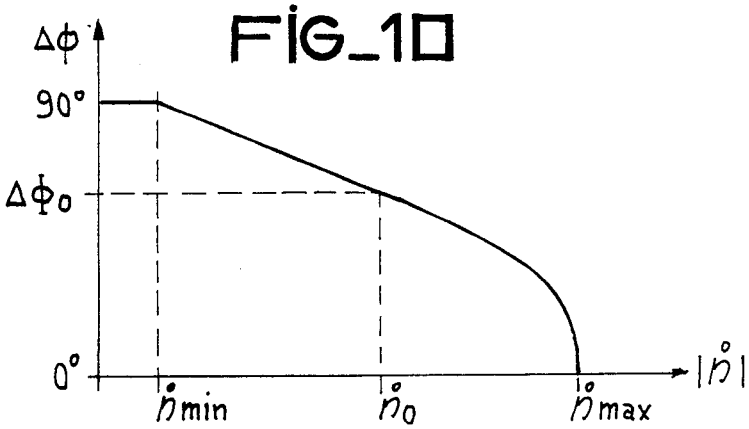
FIG. 10 illustrates the law for controlling the roll attitude of the body of the missile as a function of the magnitude of the rotation of the missile-target line of sight.

FIGS. 9 and 10 shown facing each other illustrate the laws of the acceleration $\gamma$ and of the roll piloting angle $\Delta\phi$ of the missile as a function of the modulus of the rotational vector $\dot{\eta}$.

Figure 17:
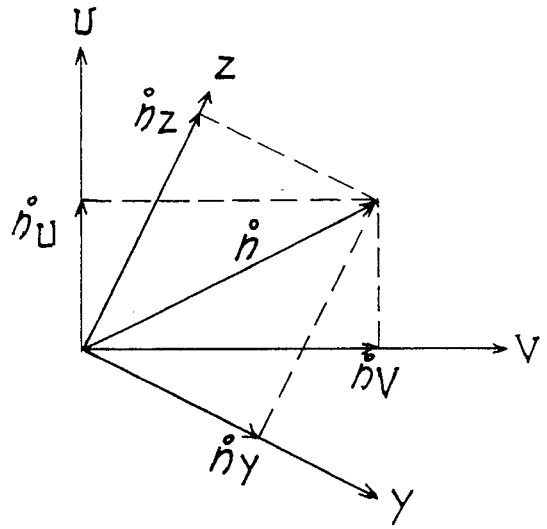
FIG. 17 is a diagram of the components of the rotational vector of the missile-target line of sight in an absolute trihedron and in the missile trihedron.

FIG. 17 is a diagram showing the components of the rotational vector $\dot{\eta}$ in an absolute trihedron U,V and in the missile trihedron Y,Z referenced to the direction of the piloting nozzle.

Figure 18:
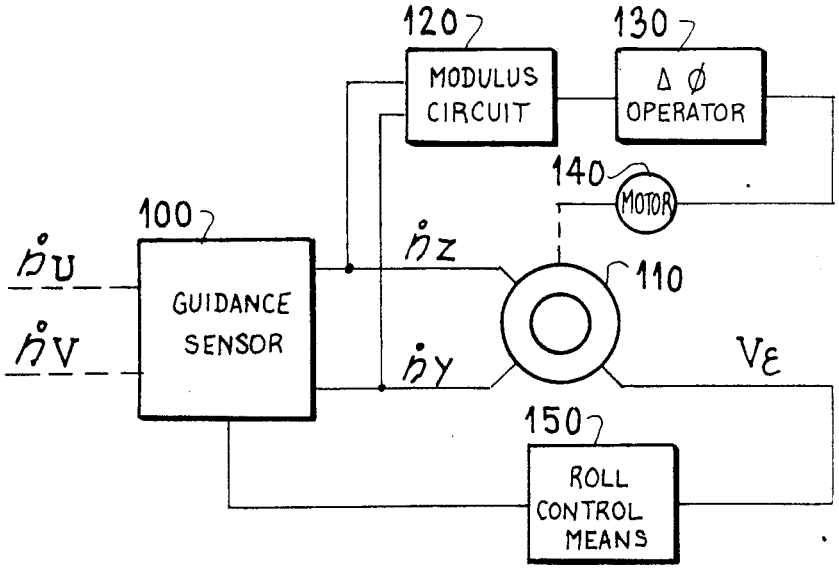
FIG. 18 shows, in the form of a block diagram, the elements of the servo loop for tracking the missile.

FIG. 18 shows, in the form of a block diagram, the servo loop for tracking the missile, which comprises the following elements: the guidance sensor 100 which delivers the components $\dot{\eta}_y$ and $\dot{\eta}_z$ of the rotational vector of the missile-target line of sight, these two components are fed to a resolver device 110 and an operator 120 which elaborates the modulus of the rotational vector $|\dot{\eta}|$, this modulus $|\dot{\eta}|$ is applied to an operator 130 for supplying an output signal $\Delta\phi$ in accordance with the guidance law shown in FIG. 10 and, through a servo motor 140, rotates the resolver 110 through an equivalent angle; finally, the output signal $V_\epsilon$ is applied to the roll control means 150 of the missile body.

The crossed component of the acceleration $\gamma_T = \gamma_N \sin\Delta\phi$ generates a spiral movement of the interception trajectory of the missile. The angular roll speed $\dot{\phi}$ of the body of the missile is then given by the following relationship:

$$\dot{\phi} = \frac{2\,V_R}{R_d \tan\Delta\phi_o}$$

in which $V_R$ is the relative speed and $R_d$ the remaining missile-target distance. The result is that the acceleration component $\gamma\eta$ ensures biased proportional navigation and the acceleration component $\gamma_T$ generates a spiral trajectory but has no effect on the convergence of the guidance on to the target.

The guidance method which has just been described may be applied to a guided missile of moderate caliber, for example of the order of 100 mm, and the magnitudes of the main parameters enumerated above may, by way of indication, be situated about the following values: speed of movement V of the missile along its trajectory of the order of 50 $ms^{-1}$, angle of descent $\theta_o$ between 60° and 90°, angle of inclination $\theta$ of the missile speed vector with respect to the descent axis between 10° and 15°, angular half aperture $\epsilon$ of the beam of the sensor of the order of 4° to 8°, altitude $R_h$ of the missile at the time of igniting the gas generator, of the order of 500 m. For these values of the main parameters, the travel duration of the terminal portion of the trajectory is between 10 and 15 seconds and, for a normal acceleration value $\gamma_N$ of the order of 25 $ms^{-2}$, the angular rotational speed during rolling $\dot{\phi}$ is of the order of 2.5 $rad.s^{-1}$, the surface of the ground swept by the beam of the sensor is about $5.10^4 m^2$. All the values of these parameters may vary depending on the specific mission of the missile.

Figure 11:
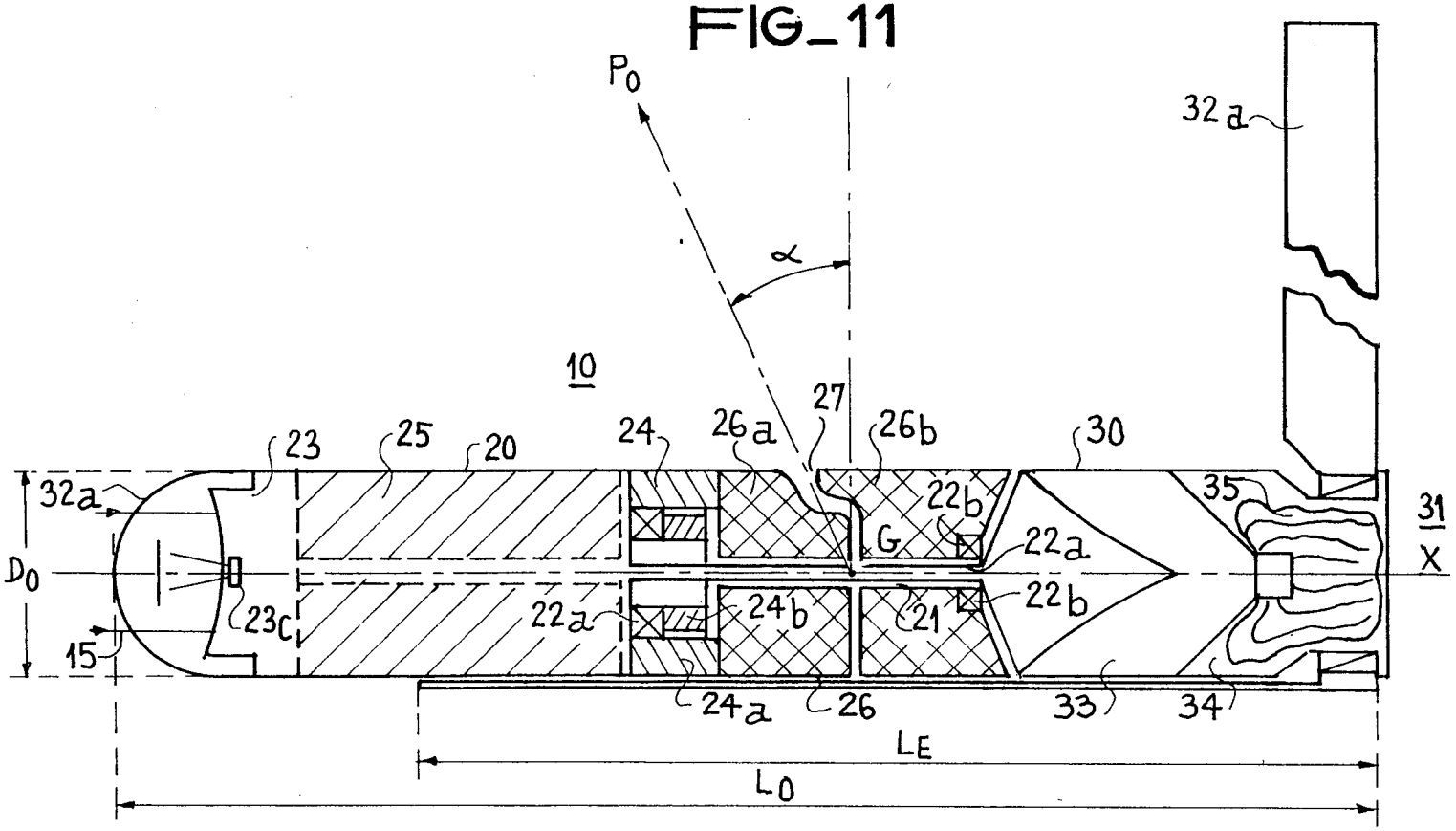
FIG. 11 is a longitudinal section of a guided missile according to the invention.

FIG. 11 is a view along a longitudinal section of one embodiment of a guided missile operating in accordance with the guidance method which has just been described.

The guided missile 10 comprises two main sections; a first main section 20, called "front section", and a second main section 30, called "rear section", which rotate with respect to each other about the longitudinal axis X of the missile. The front and rear sections are mutually coupled together through a central shaft 21. This shaft is rigidity locked with the rear section, and is carried by two bearings 22a and 22b inside the front section. Inside the front section 20 are disposed the following elements:

- an EO sensor 23 situated behind a transparent dome 23a,
- a drive means 24 for controlling the roll attitude of this front section; this drive means comprising: a first member 24 integral with the mechanical structure of this front section and a second member 24b physically coupled to the central shaft 21 coupling together the front and rear sections of the missile,
- a compartment 25 containing the electronic circuits associated with the EO sensor on the one hand and with the drive means 24 on the other and,
- a gas generator 26 coupled to a lateral nozzle 27 whose output orifice is situated on the external lateral wall of this front section.

The rear section 30 of the missile, physically integral with the central coupling shaft 21 is provided, at its base, with a stabilizing tail unit 31 formed by a set of unfoldable fins 32; in this figure, only two fins have been shown; one of the fins 32a is shown in the unfolded or active position whereas the other fin 32b is shown in the folded or inactive position. Inside this rear section are disposed the following elements:

- the military charge 33 of the missile and
- a compartment 34 for storing a parachute 35 released on the trajectory of the missile, then dropped during flight.

Such a missile may be characterized by its following principal dimensional parameters: its caliber equal to its external diameter $D_o$, its overall length $L_o$, the span of its fins $L_E$ and its total mass $M_o$.

The principal elements mentioned above will now be described. The EO sensor 23 is sensitive, for example, to the thermal energy radiated by the vehicles to be intercepted and the dome 23a is transparent to the corresponding IR radiation. This EO sensor comprises an optical assembly at the focal point of which is disposed a photodetecting element 23c for providing a beam 14 with half aperture equal to an amount $\epsilon$, this beam being materialized by its axis 15. The whole formed by the optical assembly and the photodetecting element 23c is carried by a gyroscope comprising locking means (tulipage) for immobilizing the axis of the optical beam 14 along the longitudinal axis X of the missile and precessional means for orientating, in the no locked position, this optical beam in space. Furthermore, this EO sensor comprises electronic means for detecting the presence of a thermal source intercepted by the beam and means for latching the axis of the optical beam to the straight line between target and missile.

Figure 12:
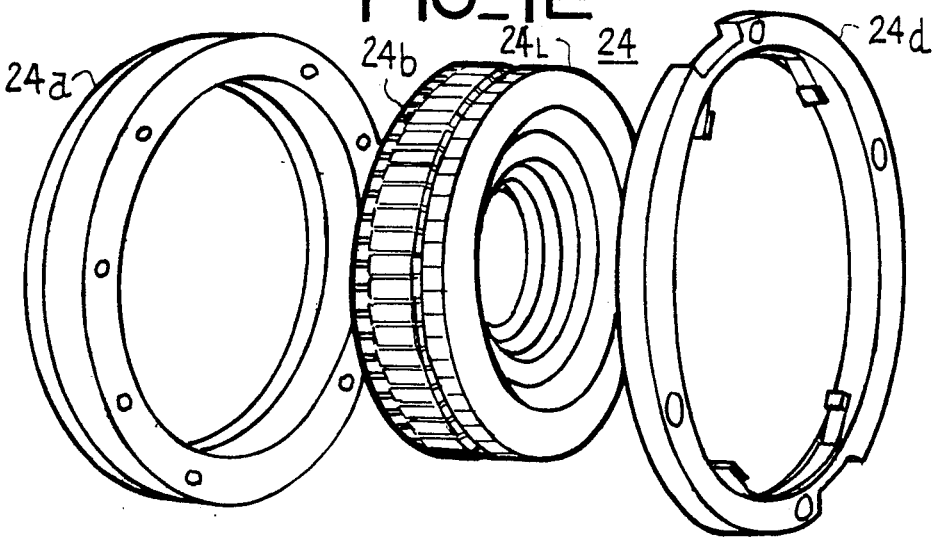
FIG. 12 shows, in an exploded view, the elements of an electric torquer motor.

The drive means 24 for controlling the roll attitude of the front section of the missile is a torquer motor. A torquer motor is a rotary multipolar electrical machine which may be coupled in direct drive with the load to be driven. This type of machine transforms electric control signals into a sufficiently high mechanical torque to obtain a given degree of precision in a speed or position servo system. A torquer motor of the "pancake type", because of its design, may be easily integrated in the structure of the missile. As shown in FIG. 12, this type of torquer motor comprises essentially three elements: a stator 24a which provides a permanent magnetic field, a laminated wound rotor 24b integral with a segmented collector 24c and a brush carrying ring 24d equipped with connections for receiving the control signals. Because of its mechanical characteristics, this torquer motor ensures rigid coupling with the load, resulting in a high mechanical resonance frequency; because of its electrical characteristics, the intrinsic response time of a torquer motor may be short and its resolution high. Moreover, the torque delivered increases proportionally with the input current and is independent of the speed or of the angular position. Since the torque is linear as a function of the input current, this type of machine is free of operating threshold. Torquer motors are commercialized more particularly by the firms ARTUS (France) and INLAND (U.S.A.). The second member 24b of the drive means, because of its connection with the rear tail unit part of the missile, is subject to a resistant torque resulting from the combination of the inertial torque of this rear section and from the aerodynamic torque provided by the tail unit. The first member 24a of the drive means comprises a control input which is connected to an amplifier which includes corrector electric networks. The input of this amplifier, during the phase of seeking a target by the sensor, receives an electric signal resulting from the comparison of the angular roll speed $\phi$ of the body of the missile and a reference value. The angular roll speed of the body of the missile may be provided by a rate gyro whose sensitive axis is aligned along the longitudinal axis of the missile. The reference value may be varied as a function of time, i.e. depending on the altitude of the missile above the ground. During the phase for piloting the missile on to the detected target, the input of the amplifier of the drive means receives an electric signal for controlling the roll attitude of the body of the missile so as to cancel out the rotation of the missile-target line of sight.

Figure 13:
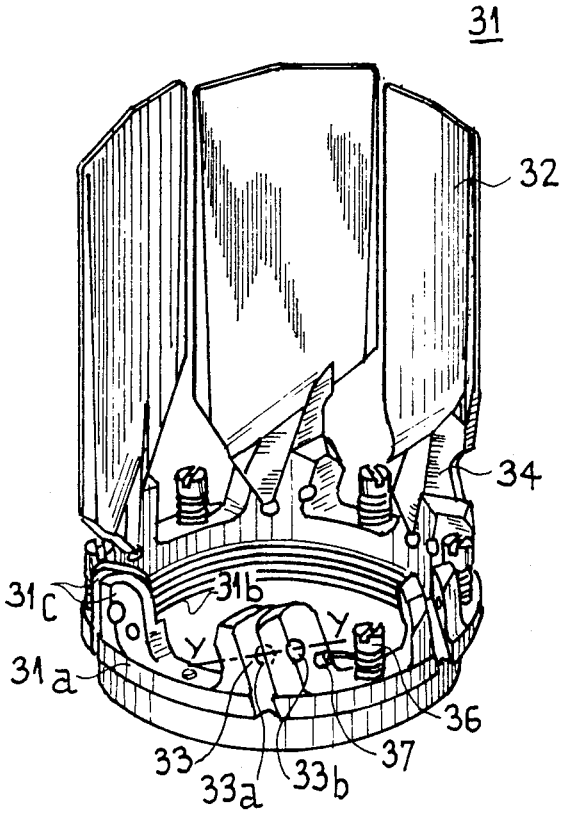
FIG. 13 shows one embodiment of the stabilizing tail unit.

The tail unit 31 of the missile is formed by fins movable between a position folded back against the body of the missile and an active unfolded or folded out position. Considering the relatively low moving speed V of the missile, the tail unit is required to provide a high aerodynamic stabilizing torque, this is obtained by means of fins of great extension which are laid tangentially against the body of the missile. FIG. 13 is a perspective view of the tail unit assembly, the fins situated at the front of the figure being omitted for the sake of clarity. The body 31a of the tail unit is an annular part having, for example, an inner thread 31b for fixing same to the base of the rear section 30 of the missile. This annular part comprises a set of sloping fork-joints 31c spaced apart evenly around the periphery of the part. In these fork-joints, a slit 33 with parallel faces receives the hinging lug 34 of the fin 32 which, by by means of a pin, may pivot in holes 33a and 33b. From the mechanical point of view, the tail unit is completed, for each of the fins, by a device for locking it in the folded out position. This device is formed, for example, by a spring locking mechanism 36 which actuates a pin 37 which may engage in a lateral notch provided for this purpose in the hinging lug of the fin. A detailed embodiment of this type of tail unit has been described in French patent PV No. 53 419, filed on Mar. 15, 1966 and published under the No. 1 485 580. Besides its stabilizing function, the tail unit supplies an aerodynamic resistant torque which is transmitted to the second member 24b of the drive means 24.

The gas generator 26 is essentially formed by a combustion chamber inside which are disposed two blocks 26a and 26b of solid propergol. Between these two blocks of propergol is located an ejection nozzle 27 whose output orifice opens into the lateral wall of the body of the missile. The thrust direction of the gases Po is inclined by an angle $\alpha$ towards the front of the missile so as to provide the two acceleration force components: the longitudinal force $F_L$ for compensating the force of the Earth's gravity and the normal force $F_N$ used in combination with the roll attitude of the body of the missile to vary the orientation of the speed vector V of the missile. The section of the combustion chamber and, consequently, the section of the propergol blocks may be of a toric shape so as to leave a free passageway about the longitudinal axis X of the missile, and more especially for disposing the coupling shaft 21 of the front and rear sections of the missile.

The total mass $m_p$ of propergol must satisfy the following relationship:

$$m_p = \frac{F \cdot Td}{g \cdot Is}$$

where F is the required thrust force, Td the maximum travel duration of the missile over the terminal portion of its trajectory and Is the specific impulse of the propergol used.

The military charge may be advantageously of the so-called "hollow charge" type which produces a jet capable of piercing the protecting armor of vehicles. So as to ensure free passage of the jet along the longitudinal axis of the missile, the shaft 21 for coupling the front and rear sections of the missile together comprises a recess 21a in its axial portion; moreover, a free passage may be provided also in the central part of compartment 25 containing the electronic circuits associated with the EO sensor 23 and with the drive means 24.

The braking parachute 35 of the missile may be a parachute similar to those used in the technique of braked projectiles such as aviation bombs. With this parachute are associated release and dropping devices not shown. The duration of the action of the parachute depends on the mass Mo of the missile and on the ratio of the cruising speed to the predetermined speed V over the terminal portion of the trajectory of the missile.

The guided missile which has just been described in detail may be a missile of average caliber of the order of 100 mm and with an elongation factor of about 6 to 7 for a weight of 10 to 15 kgs. However, it may be pointed out that all its values may be modified within wide limits depending more particularly on the destructive power of the military charge carried.

The guided missile, in itself, such as has just been described, may form a sub-projectile of a larger sized projectile whose main function is to carry this or a group of such sub-projectiles over the cruising portion as far as the terminal position of the firing trajectory.

Figure 14:
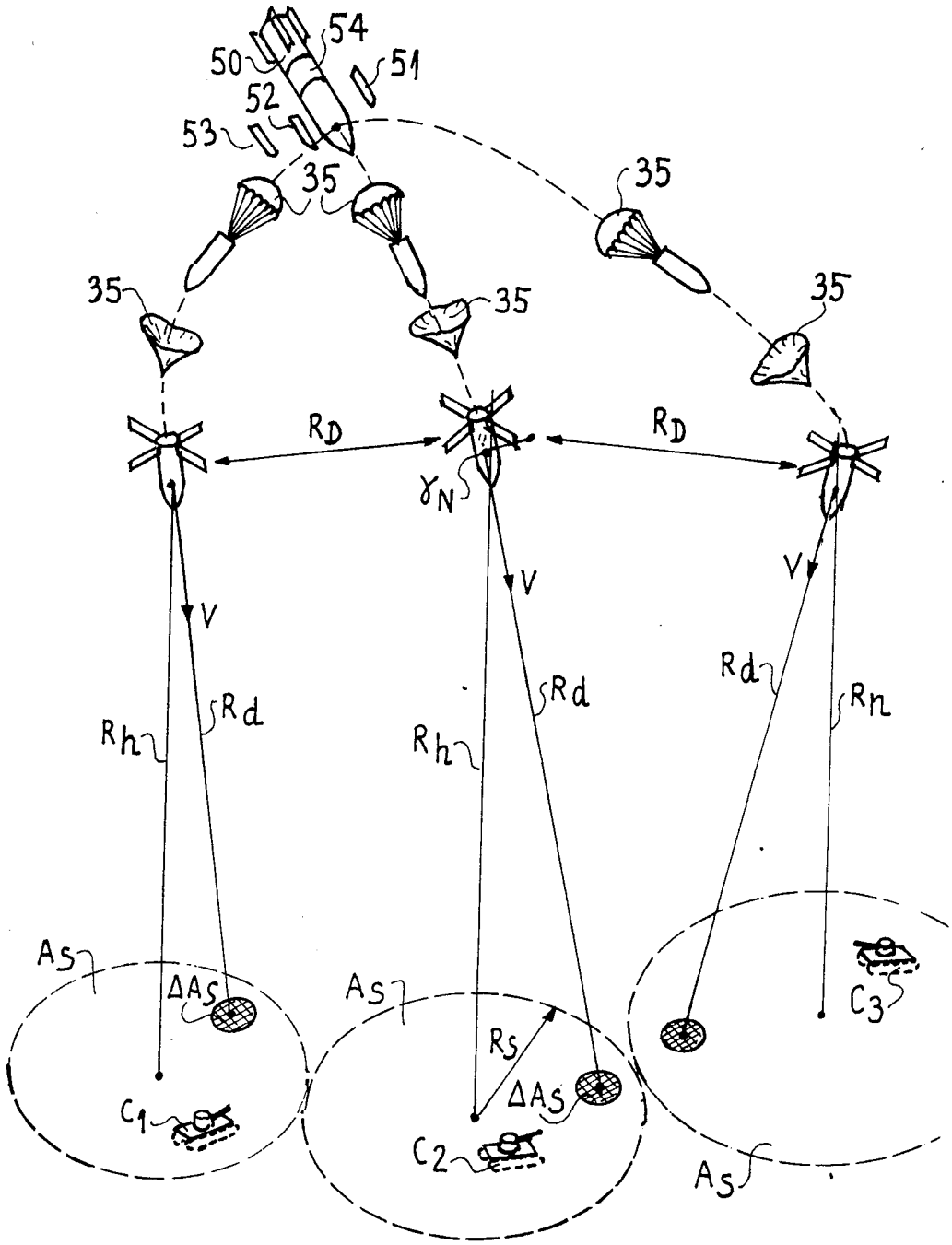
FIG. 14 illustrates one application of the guided missile to the destruction of a group of land vehicles.

Referring now to FIG. 14 which illustrates the transitory portion between the cruising portion and the terminal portion of the firing trajectory, the carrier projectile 50 transports sub-projectiles or guided missiles 51, 52 and 53 situated in a section 54. On reaching the transition portion of the trajectory, the guided missiles are ejected and dispersed at a high initial speed substantially equal to that of the carrier projectile and are at a predetermined altitude above the ground. So as to reduce their initial moving speed to reach the adequate speed V for the acquisition and interception of targets, the braking parachute 35 of the missile is released for a determined period of time, after which the mechanical connection between the missile and the parachute is broken so as to drop this latter. The stabilizing tail unit 31 is unfolded and the front section of the missile is set in self-rotation. Then, the gas generator for producing the transverse thrust force $F_N$ is activated and the phase for seeking a potential target situated on the ground may begin. Because of the ejection force imparted by the carrier vehicle 50 at the time of separation thereof from the sub-projectiles 51 to 52, there results a certain dispersion distance $R_D$ at the moment when the operation for seeking targets by the sensor of the sub-projectile begins.

Figure 15:
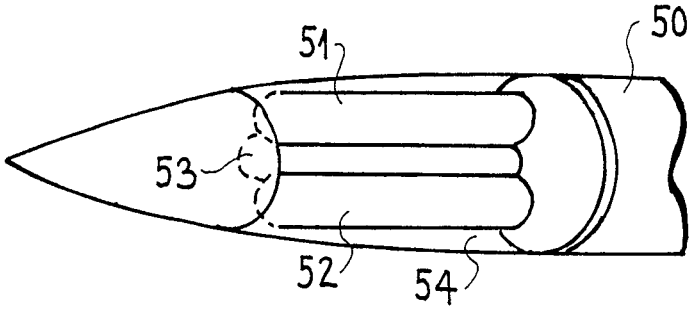
FIG. 15 is an exploded view of the compartment of a carrier projectile housing a plurality of missiles.

FIG. 15 is a partial exploded view of section 54 of the carrier projectile 50 which shows one example of installing a group of three guided missiles 51, 52 and 53. These missiles are evenly spaced apart about the longitudinal axis of the carrier projectile, and furthermore, an identical group of missiles may be installed in tandem, if necessary.

Figure 16:
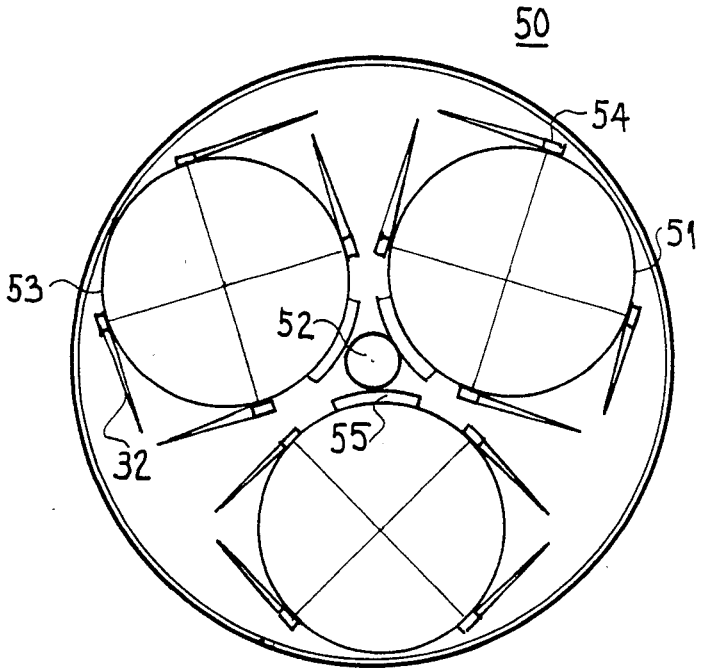
FIG. 16 is a sectional view of the carrier projectile showing the relative arrangement of the guided missiles in the compartment.

FIG. 16 is a cross section of the carrier projectile 50 which shows the relative arrangement of the guided missiles 51, 52 and 53 inside the housing section 54. The guided missiles abut against elements 55 actuated by an ejection mechanism 56 whose complementary function is to communicate a certain amount of movement to the missiles during ejection thereof so as to ensure a predetermined relative dispersion. The ejection mechanism 56 may be of a known mechanical type actuated by hydraulic, pneumatic or possibly electric means. So as to minimize the cross section of the carrier projectile, the missiles may be provided with a tail unit formed of four fins 32, capable of being folded out, so as to allow a certain material recessing thereof.

Table 1 is a recapitulary table of the sequence of the principal operations effected by the missile during its firing trajectory.

The guided missile of the invention is not limited in its characteristics and applications to the embodiment described. More especially, the sensor may be of the passive or semi-active type and operate in the optical or radar bands of the electromagnetic spectrum, the relative arrangement of the elements such as the drive means 24 and the military charge 23 may be modified.

The invention is not limited to its application to an independent missile, but also applies to a missile carried by conventional vehicles or aircraft.

TABLE 1

| | |
|---|---|
| $t_o$ | end of the carried cruising phase of the missile, locking of the sensor to the longitudinal axis of the missile, starting up of the rotor of the gyroscopio elements of the missile, setting of the gyroscopic references, energization of the primary electric energy source, |
| $t_o + T_1$ | ejection of the missile from its carrier, |
| $t_o + T_2$ | opening of the braking parachute, |
| $t_o + T_3$ | dropping of the braking parachute and opening of the stabilizing tail unit, |
| $t_o + T_4$ | ignition of the gas generator and application of a transverse thrust force to the missile and sensitization of the sensor of the missile, |
| $t_o + T_5$ | the body of the missile set in self-rotation about its longitudinal axis, |
| $t_o + T_6$ | detection of the presence of a potential target on the ground and unlocking of the sensor and locking of the beam of the sensor on the image of the detected |

TABLE 1-continued

| | |
|---|---|
| | target, |
| $t_o + T_7$ | measurement of the rotation of the missile-target line line of sight and elaboration of the order for piloting the missile, |
| $t_o + T_8$ | impact on the target and setting off of the military charge. |

I claim:

1. A method for guiding a missile during a terminal portion of the missile's trajectory, said missile having a sensor with a beam, said sensor being sensitive to energy radiated by a potential target comprising the following steps for seeking the target:

(a) immobilizing the beam of the sensor along the longitudinal axis of the missile;

(b) imparting to the missile:

a rotation about the longitudinal axis of the missile at a given angular roll speed, and a spiral line movement in order that the beam of the sensor describes a surface of revolution by creating a transverse thrust force normal to the direction of the speed of movement of the missile;

(c) detecting an image of a possible target picked up by the beam of the sensor;

and comprising the following steps for piloting the missile:

(d) freeing the beam of the sensor and maintaining the axis of this beam pointed at the image of the detected target to measure the rotation of the missile-target line of sight;

(e) elaborating a piloting order proportional to the measured magnitude of the rotation of the line of sight; and (f) applying this piloting order to modify the roll attitude of the missile.

2. The guidance method as claimed in claim 1, wherein the speed of movement of the missile is established at a given value, at the moment when said missile enters the terminal portion of its trajectory.

3. The guidance method as claimed in claim 2, wherein the speed of movement of the missile over the terminal portion of the trajectory is maintained substantially constant by creating a longitudinal thrust force having a magnitude substantially equal to the force resulting from the Earth's gravity field and in a direction aligned with the longitudinal axis of the missile.

4. The guidance method as claimed in claim 3, wherein the angular roll speed of the body of the missile is increased along the terminal portion of the trajectory of the missile.

5. A guided missile having a sensor which is sensitive to energy radiated by a potential target and comprising first and second main sections mutually coupled together and rotating with respect to each other about the longitudinal axis of the body of the missile;

the first section containing an electro-optical sensor and comprising a drive means having a first member integral with the structure of the first section, a second member physically coupled to the second main section, and a control input connected through an amplifier to a generator of piloting orders so as to vary the roll attitude of the body of the missile, and a gas generator which feeds a lateral nozzle so as to provide a transverse thrust force;

the second main section comprising at its base a stabilizing tail unit formed of fins able to be folded out, said sensor of the first section having locking device means for immobilizing a sensor beam along the longitudinal axis of the missile during a step of seeking a target.

6. The missile as claimed in claim 5, wherein the second member of said drive means is mechanically coupled to the rear section of the missile by a central coupling shaft.

7. The missile as claimed in claim 6, wherein said drive means is an electric torquer motor.

8. The missile as claimed in claim 7, wherein said rear section of the missile comprises a military charge of the "hollow charge" type and said central coupling shaft comprises an axial recess.

9. The missile as claimed in claim 8, wherein said rear section of the missile comprises a compartment for storing a parachute.

10. The missile as claimed in claim 9, wherein the stabilizing tail unit is formed from a set of fins able to be folded back against the body of the missile.

11. A missile as claimed in claim 5, forming a sub-projectile of a carrier projectile.

12. A missile as claimed in claim 6 forming a sub-projectile of a carrier projectile.

13. A missile as claimed in claim 7 forming a sub-projectile of a carrier projectile.

14. A missile as claimed in claim 8 forming a sub-projectile of a carrier projectile.

15. A missile as claimed in claim 9 forming a sub-projectile of a carrier projectile.

16. A missile as claimed in claim 10, forming a sub-projectile of a carrier projectile.

* * * * *